United States Patent [19]

Perry

[11] 3,967,606

[45] July 6, 1976

[54] FUEL PUMP FOR INTERNAL COMBUSTION ENGINES

[76] Inventor: John C. Perry, 971 Mira Mar Drive, Vista, Calif. 92083

[22] Filed: June 19, 1974

[21] Appl. No.: 480,952

[52] U.S. Cl. ..... 123/139 AJ; 123/139 AV; 417/279; 417/507

[51] Int. Cl.[2] ..... F02M 39/00

[58] Field of Search ..... 123/139 AJ, 139 AH, 123/139 AZ, 139 AF, 139 AV, 139 AY; 417/279, 507; 46/78

[56] References Cited

UNITED STATES PATENTS

| | | | |
|---|---|---|---|
| 2,383,250 | 8/1945 | Hewitt | 417/279 |
| 2,707,051 | 4/1955 | Mailhot | 123/139 AV |
| 3,425,403 | 2/1969 | May | 123/139 AJ |
| 3,698,368 | 10/1972 | Yamamoto | 123/139 AJ |
| 3,800,770 | 4/1974 | Baribeau | 123/139 AJ |
| 3,805,758 | 4/1974 | May | 123/139 AJ |

*Primary Examiner*—Charles J. Myhre
*Assistant Examiner*—Daniel J. O'Connor

[57] ABSTRACT

A fuel pump for an internal combustion engine of the type wherein cyclic pressure fluctuations are produced in the engine crankcase chamber during engine operation by the reciprocating motion of an engine piston. The pump embodies fuel pumping means including a pulsatory pumping member or pulsator, such as a diaphragm, and is mounted directly on the engine with the pumping pulsator exposed directly to the engine crankcase chamber in such a way that the chamber pressure fluctuations drive the pulsator in its pulsating pumping motion to pump fuel from the fuel inlet to the fuel outlet of the pump. Also embodied in the pump are a novel fuel pressure regulating valve for maintaining a substantially constant fuel outlet pressure regardless of engine speed and an automatic fuel shut-off valve for blocking fuel leakage through the pump under the action of head pressure or other forces when engine operation ceases.

20 Claims, 7 Drawing Figures

FUEL PUMP FOR INTERNAL COMBUSTION ENGINES

BACKGROUND OF THE INVENTION

1. Field of the Invention

This invention relates generally to internal combustion engines of the kind having a reciprocating piston whose reciprocating motion produces cyclic pressure fluctuations in the engine crankcase. The invention relates more particularly to a novel fuel pump for such engines.

2. Discussion of the Prior Art

As will become readily evident from the following description, the fuel pump of the invention may be adapted for use on a variety of engines and engine sizes. One particularly useful application of the fuel pump, however, is on a small internal combustion engine of the kind used in radio controlled model airplanes and the like. The fuel pump will be described in the context of this particular application.

A typical model airplane engine is a single cylinder two-cycle engine having a body providing a cylinder proper and a crankcase. The crankcase chamber opens through the front and rear ends of the crankcase, and these open ends are closed by front and rear end plates which are bolted to the crankcase. Journelled in the front end plate in a crankshaft having an inner crank end within the chamber connected by a connecting rod to a piston movable in the cylinder and an outer coupling end which extends externally of the engine for mounting a propeller. The rear crankcase end plate of the standard engine serves merely as a closure for the rear end of the crankcase.

Fuel and air enter the engine through a carburetor having an intake air venturi and a fuel jet which opens to the venturi throat. The venturi communicates to the engine crankcase chamber through a valve which opens and closes in timed relation to the reciprocating motion of the piston in such a way that air is drawn into the chamber during each upstroke of the piston and then displaced from the chamber into the cylinder during the following downstroke of the piston. The resulting air flow through the venturi produces in the venturi throat a partial vacuum which draws fuel into the intake air stream from the engine fuel tank through the fuel jet. The carburetor has a throttle valve which is adjustable to regulate the air and fuel flow to the engine and thereby engine speed.

This method of utilizing carburetor venturi vacuum to induce fuel flow to the engine has several disadvantages which are well known to those skilled in the art of model airplanes and hence need not be elaborated on. Suffice it to say that the rate of fuel flow to the engine is extremely sensitive to fuel tank conditions, fuel head pressure, and the forces of flight active on the fuel, particularly at idling and low speed settings of the throttle valve, with the result that the engine often runs excessively lean or excessively rich and frequently cuts out. Moreover, since the engine lubricating oil is contained in the fuel, the delivery of an excessively lean mixture to the engine may result in serious engine damage.

In an effort to avoid the above and other disadvantages of the simple vacuum draw fuel system discussed above, a variety of pressurized fuel systems have been devised. Most of these pressurized fuel systems have utilized in one way or another the pressure fluctuations which occur in the crankcase of single cylinder two-cycle engines, such as model airplane engines, during engine operation. In this regard, it is well known that during operation of such an engine, each upstroke of the piston produces a partial vacuum in the crankcase through a then open valve. During the following downstroke of the piston, the valve closes and the mixture is displaced from the crankcase into the engine cylinder, thereby producing a positive pressure in the crankcase. Thus, during engine operation, alternate negative and positive pressure pulses are produced in the crankcase.

Attempts have been made to utilize these pressure pulses to effect a fuel pumping action or othewise achieve pressurized fuel delivery. For example, pulse pressure pumps operable by the crankcase pressure fluctuations have been tried. However, these pumps were not successful for the reason that they were connected to the engine crankcase by tubes or the like which damped out the pressure fluctuations at the pump above a certain engine speed. Other pressurized fuel systems utilizing the crankcase pressure pulses are not totally successful or satisfactory for model airplane use for the reason that they lack fuel pressure regulating means, which are required to obtain a relatively constant fuel pressure over the total engine operating range or utilize fuel pressure regulating arrangements that are ill-suited to model airplane use because of their size and complexity or their reliance on vacuum to draw fuel through the carburetor.

By way of example, one of the most commonly used pressurized fuel systems for model airplane engines is the so-called "timed crankcase pressure system". In this system, the fuel tank is connected to the engine crankcase through a fitting which allows only positive pressure pulses to the tank. As a result, the tank pressure may build up to several pounds when the engine is running at high speeds. When the engine is throttled back, this high tank pressure will cause flooding of the engine. On the other hand, if the idle setting of the fuel system is made to accommodate the high pressure build up during high speed engine operation, low speed engine operation with the fuel tank depressurized will result in the delivery and an excessively lean mixture to the engine, thereby creating the possibility of engine damage or cessation of engine operation.

An improved system of this latter kind has been devised with a pressure regulating feature to avoid the problems discussed. This improved system is still sensitive to fuel head pressure, is relatively complex, and requires substantial modification of the engine and hence is not totally satisfactory.

SUMMARY OF THE INVENTION

This invention provides an improved fuel pump for internal combustion engines, such as the model airplane engine discussed above, of the kind wherein cyclic pressure fluctuations are produced in the engine crankcase chamber by the reciprocating motion of an engine piston. The fuel pump has fuel pumping means including a pulsatory pressure responsive pumping member, or pulsator as it is referred to in places herein, and is mounted on the engine body with the pumping pulsator exposed directly to the crankcase chamber, such that the pressure fluctuations in the chamber during engine operation drive the pulsator in a pulsating pumping action. The pumping means are operative in response to this pumping motion of the pulsator to effect fuel flow from a fuel inlet to a fuel outlet of the pump. The fuel inlet is connected to a fuel tank and the fuel outlet is connected to the engine carburetor, such that the pump delivers fuel under pressure from the tank to the carburetor for mixing with the engine intake air.

As noted earlier, the invention is described in connection with a fuel pump for a model airplane engine. This described fuel pump has a housing with a mounting flange which is sized and shaped to be bolted to the rear end of the crankcase of a standard engine in place of the rear crankcase closure plate of the standard engine. The inner end of the pump housing is exposed at the inner side of the mounting flange directly to the crankcase chamber. In this regard, it is significant to note that the fuel pump may be installed as an original part of the engine or may be sold as a separate unit to be installed on standard engines in place of its rear crankcase closure plate.

The pumping pulsator of the described engine is a pump diaphragm which is directly exposed to the pressure fluctuations in the engine crankcase chamber through openings in the inner end of the pump housing. These pressure fluctuations produce a pulsating pumping motion of the diaphragm which, in conjunction with pump valve means arranged in the fuel passage through the pump, effects a pumping action for pumping fuel through the passage from the pump inlet to the pump outlet.

The described mounting of the pump directly on the engine body with the pumping pulsator exposed directly to the engine crankcase chamber constitutes one important feature of the invention since it enables the pressure fluctuations in the chamber to react fully and instantaneously on the pulsator to effect an efficient pumping action over the entire range of engine operation from idling to full speed. Other important features of the invention reside in a unique pressure regulating valve and a fuel shut-off valve which are embodied directly in the pump to maintain a substantially constant fuel pressure at the pump outlet over the entire range of engine operation and to block fluid leakage through the pump, due to fuel head pressure, or other forces, when the engine stops. The fuel pump also has a simple, unique, totally self-contained wafer construction which requires no modification whatsoever of the engine nor any plumbing other than a fuel line from the fuel tank to the pump and a fuel line from the pump to the carburetor. Finally, since the fuel pump delivers fuel under substantially constant pressure to the engine under all operating conditions, the hazard of engine damage due to the engine running too lean is eliminated and a larger carburetor bore can be utilized with a resultant increase in engine power.

DESCRIPTION OF THE PREFERRED EMBODIMENT

Figure 1:
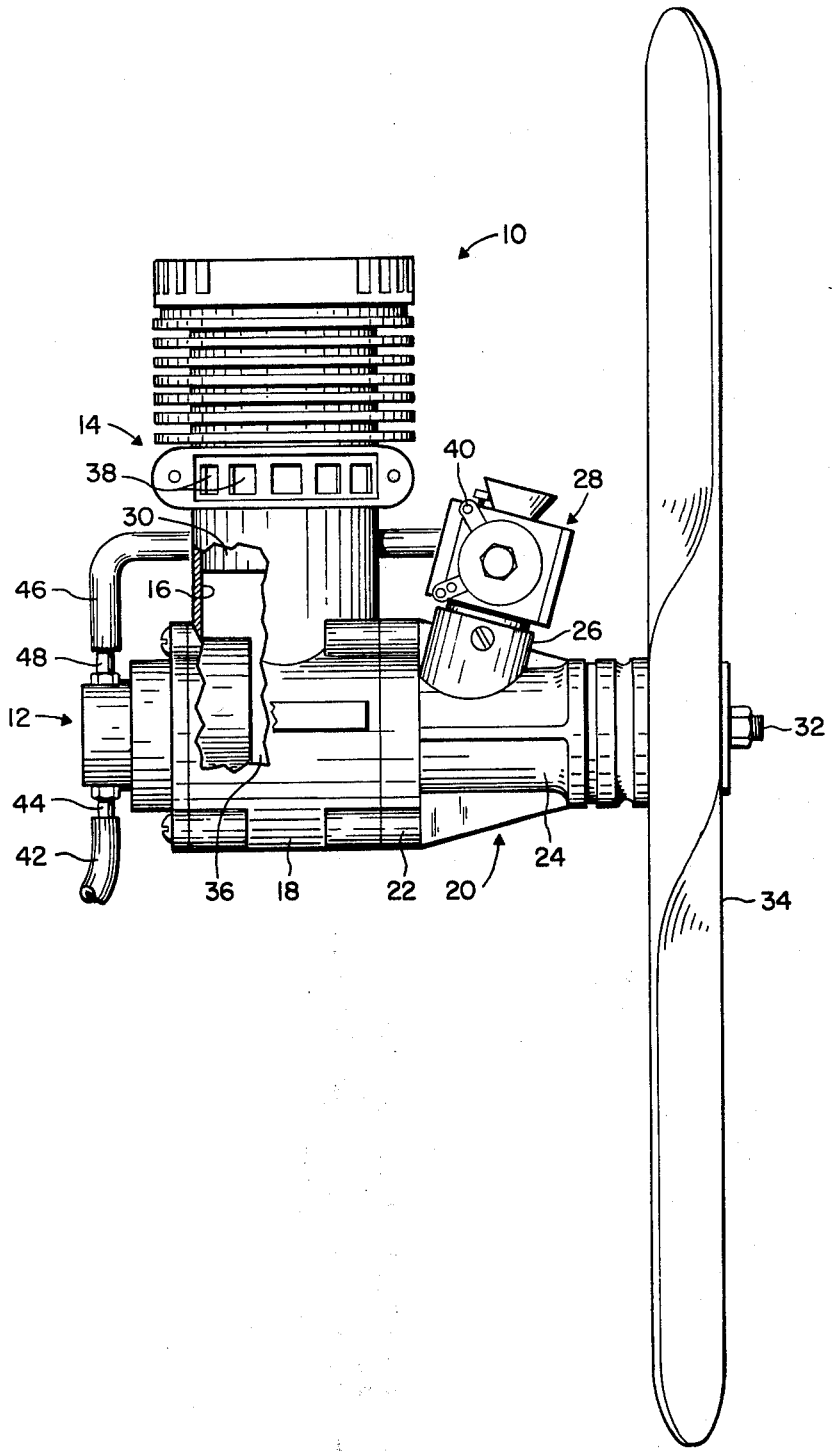
FIG. 1 is a side elevation of a model airplane engine mounting a fuel pump according to the invention, with a part of the engine broken away for the sake of clarity.
Figure 2:
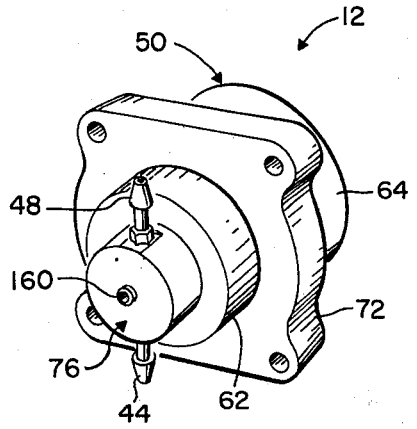
FIG. 2 is an enlarged perspective view of the fuel pump looking at its outer end.
Figure 3:
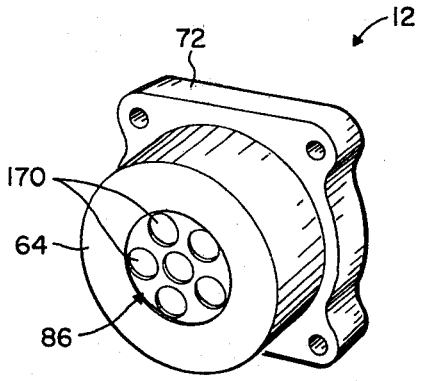
FIG. 3 is a view similar to FIG. 2 looking at the inner end of the pump.
Figure 4:
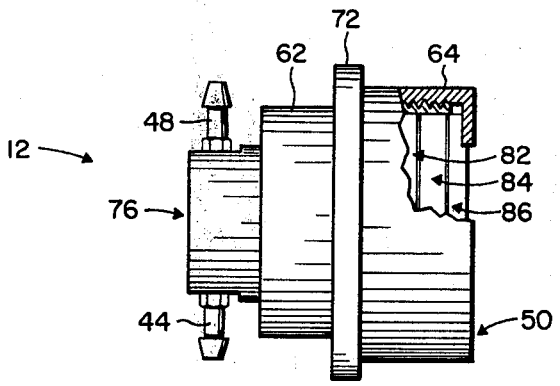
FIG. 4 is an enlarged side elevation of the fuel pump with a portion of the pump housing broken away for clarity.

Referring first to FIG. 1 of the drawings, there is illustrated an internal combustion engine 10, in this instance a model airplane engine, mounting a fuel pump 12 according to the invention. Except for the fuel pump, the engine is conventional and hence need not be described in elaborate detail.

Engine 10 has a body 14 providing a normally upper cylinder 16 and a normally lower crankcase 18. The crankcase has open front and rear ends. Extending forwardly from the crankcase 18, coaxially therewith, and closing its front end is a front engine housing 20 having a rear mounting plate 22 and a forward, generally tubular portion 24. Mounting plate 22 is secured by bolts (not shown) to the front end of the crankcase. On the upper side of the housing portion 24 is a nipple 26 in which is mounted the engine carburetor 28. In a standard model airplane engine, the rear open end of the crankcase 18 is closed by a rear case or plate which is bolted to the rear end of the crankcase. In the engine shown in the drawings, this rear plate is replaced by the fuel pump 12 which will be described presently. Suffice it to say here that the fuel pump closes the rear end of the crankcase.

Movable in the cylinder 16 is a piston 30. Piston 30 is connected by a connecting rod (not shown) to the crank (not shown) of a crankshaft 32 which is journalled in a bearing within the front engine housing 20. The front end of the crankshaft extends beyond the front end of the housing to provide a coupling end for mounting a propeller 34.

During operation of the engine, the piston 30 is driven in a reciprocating motion within the cylinder 16 and drives the crankshaft 32 and thereby the propeller 34 in rotation. During each upstroke of the piston, a negative pressure or partial vacuum is created in the crankcase chamber 36 which draws in a fuel/air charge from the carburetor 28 through a valve port (not shown) in the crankshaft which opens during the piston upstroke. During the following downstroke of the piston, the crankshaft valve port closes, and the fuel/air charge is displaced from the chamber 36 into the cylinder 16 above the piston through an intake port (not shown). The charge is compressed during the upstroke and ignited by the engine glo-plug (not shown). The resulting combustion of the mixture drives the piston through the downstroke, near the end of which the spent combustion gas is exhausted from the cylinder through an exhaust port (not shown) and the engine exhaust openings 38. The cycle is then repeated. Carburetor 28 includes a throttle valve with an operating arm 40 for regulating the air and fuel flow to the engine and thereby the engine speed.

From this description of the engine 10, it will be understood that the reciprocating motion of the piston 30 produces cyclic pressure fluctuations, consisting of alternate positive and negative pressure pulses, within the crankcase chamber 36. As will appear from the following description of the fuel pump 12, these pressure fluctuations or pulses operate the pump to effect the pumping of fuel under pressure from the engine fuel tank (not shown) to the carburetor 28. The fuel flows from the tank to the pump through a hose 42 which connects to the pump inlet 44 and from the pump to the carburetor through a hose 46 which connects to the pump outlet 48.

Fuel pump 12 will now be described by reference to FIGS. 2–6. In general terms, the fuel pump comprises a housing 50 containing fuel pumping means 52 including a pulsatory fuel pumping member 53, or pulsator, as it is referred to in places herein, which is movable with a pulsating pumping motion. The pumping means are operative in response to this pumping motion of the pulsator, to pump fuel from the pump inlet 44 to the pump outlet 48 through a fuel passage 54 within the pump. Arranged within this fuel passage is a fuel shut-off valve 56 for blocking fuel leakage through the passage when the pump is inoperative and a fuel pressure regulating valve 58 for regulating the fuel delivery pressure to maintain a substantially constant fuel pressure at the pump outlet 48, regardless of the pulsatory frequency of the pumping pulsator 53, when the pump is operating.

Fuel pump 12 is mounted on the engine 10 with the pumping pulsator 53 exposed directly to the engine crankcase chamber 36, through openings 60 in the pump. The pulsator is thus exposed directly to the pressure fluctuations or pulses in the chamber during engine operation. These pressure fluctuations drive the pulsator in its pulsating pumping motion to pump fuel under substantially constant pressure from the fuel tank to the engine carburetor 28 for mixing with the intake air passing through the carburetor. When the engine stops, the fuel cut-off valve 56 closes to prevent leakage of fuel to the carburetor under the force of the fuel pressure head, a siphoning action, or other forces active on the fuel.

Referring now in more detail to the particular fuel pump illustrated, the pump housing 50 comprises inner and outer telescopically interfitting, threadedly coupled sleeves 62 and 64. The inner sleeve 62 has an inturned flange 66 with an inner axially projecting lip 68 at the outer or upper end of the sleeve, as it is viewed in FIG. 6. The outer sleeve 64 has an inturned flange 70 at its outer or lower end. About the inner or upper end of the outer sleeve is a mounting plate or flange 72 which is similar in outline to the mounting flange 22 of the front engine housing 24 and is apertured to receive screws for securing the flange to the rear end of the engine crankcase 18, as explained presently. Sleeves 62, 64 are joined by screw threads 74.

Figure 5:
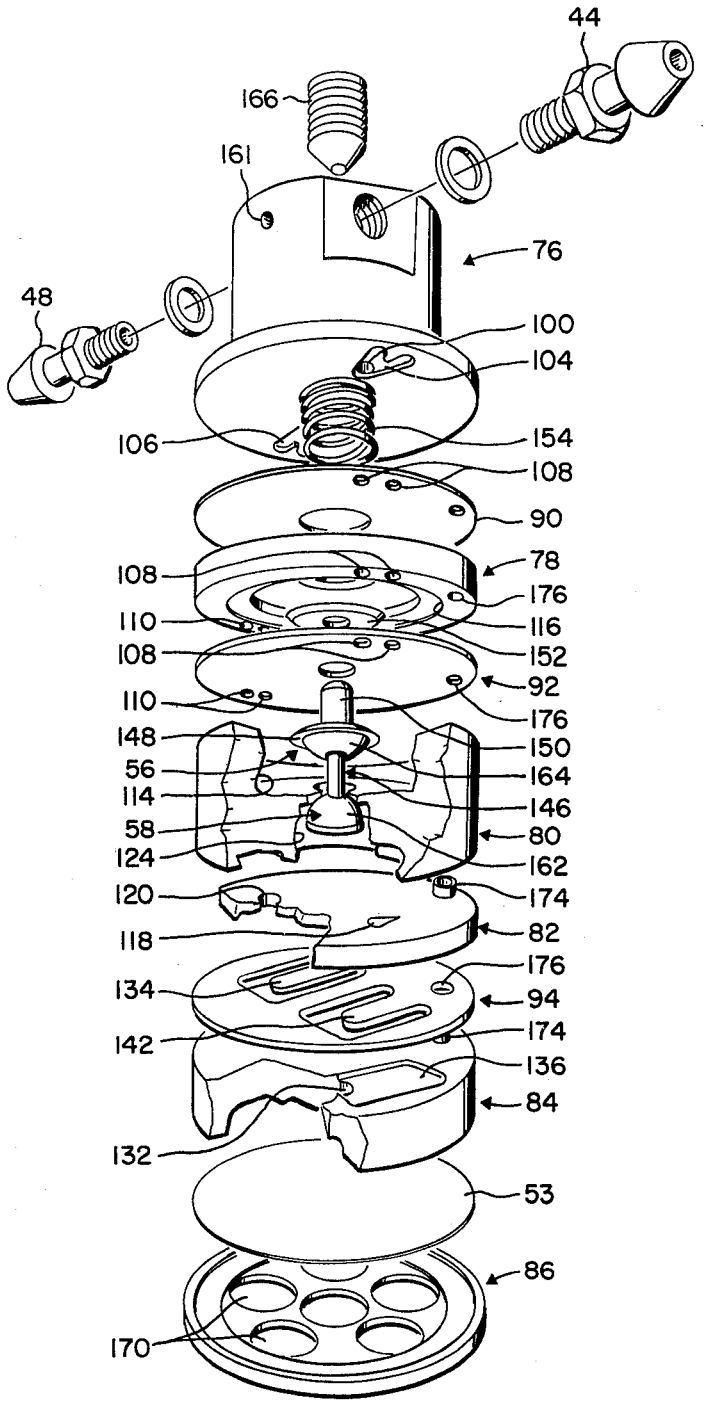
FIG. 5 is an exploded perspective view of the pump with its housing omitted for the sake of clarity.
Figure 6:
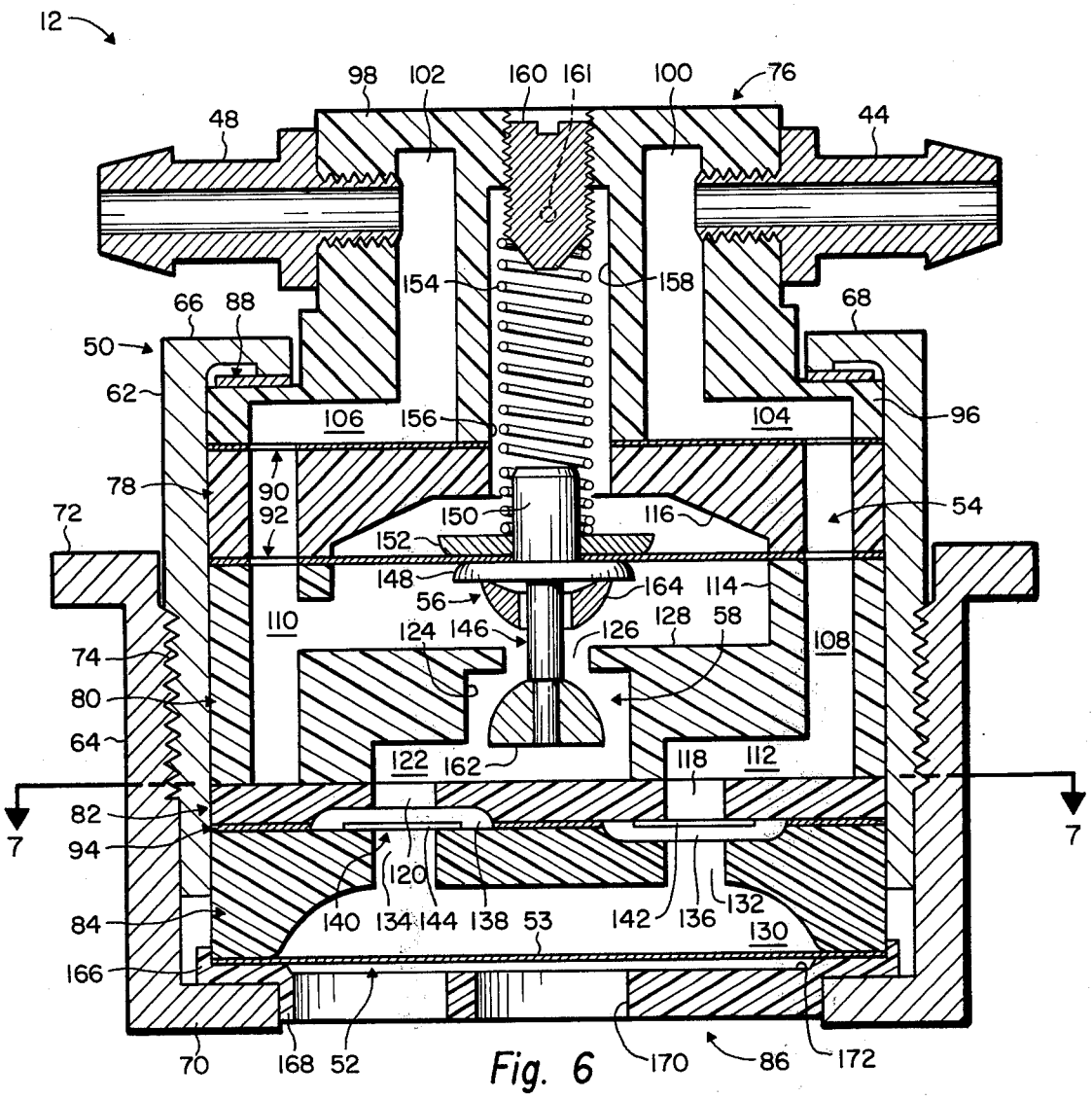
FIG. 6 is an enlarged cross-section through the pump.

Coaxially arranged within the pump housing 50 is a stack 76 of elements including a number of wafer-like elements, herein referred to as wafers, which are preferably injection molded from plastic and are designated from top to bottom in FIGS. 5 and 6, by the reference numerals 76, 78, 80, 82, 84 and 86. In the ensuing description, these wafers are referred to as a top wafer 76, transfer wafer 78, valve wafer 80, flapper wafer 82, pump wafer 84, and restrictor wafer 86. The element stack includes in addition to these wafers, a top gasket 88, a transfer gasket 90, a regulator diaphragm 92, a flapper valve disc 94, and a flexible diaphragm 53 which is the pulsator referred to earlier. Top gasket 88 is interposed between the lip 68 of the inner housing sleeve flange 66 and an outwardly directed flange 96 on the inner or lower end of the top wafer 76. Transfer gasket 90 is interposed between the top wafer and the transfer wafer 78. Regulator diaphragm 92 is placed between the transfer wafer 78 and the valve wafer 80. Flapper valve disc 94 is positioned between the flapper wafer 82 and the pump wafer 84. Finally, the pump diaphragm 53 is interposed between the pump wafer 84 and the restrictor wafer 86. The several elements of the stack 76 are clamped firmly together between the shoulders 66, 70 of the pump housing sleeves 62, 64.

The top wafer 76 has a cylindrical portion 98 which extends axially from the wafer flange 96 through and above the outer or upper end of the inner pump housing sleeve 62. Entering the inner or lower face of the wafer and extending upwardly or outwardly therethrough are two diametrically opposed bores 100, 102, the lower ends of which open laterally to radial recesses 104, 106, respectively, in the lower wafer face. As shown in FIG. 5, these recesses progressively increase in width toward their outer ends.

The fuel pump inlet 44 comprises a nipple which is threaded in the protruding end 98 of the top wafer 76 and contains a fuel passage opening to the upper end of bore 100. The fuel pump outlet 48 comprises a nipple which is also threaded in the protruding end of the top wafer, diametrically oposite the inlet nipple, and contains a fuel passage opening in the upper end of bore 102.

Extending axially through the transfer gasket 90, the transfer wafer 78, the regulator diaphragm 92, and the valve wafer 80 are diametrically opposed pairs of bores 108, 110. The upper ends of bores 108 open upwardly to the outer end of the top wafer recess 104. The lower ends of these bores open laterally to a radial recess 112 in the lower face of the valve wafer 80. The upper ends of bores 110 open upwardly to the outer end of the top wafer recess 106. The lower ends of bores 110 open laterally to a cylindrical recess 114 in the upper face of the valve wafer 80, which recess is spanned and closed at its upper side by the regulator diaphragm 92. This diaphragm also spans and closes the lower side of a recess 116 in the lower face of the transfer wafer 78.

The inner end of the lower valve wafer recess 112 opens downwardly to a flapper valve port 118 in the flapper wafer 82. The flapper wafer has a second flapper valve port 120 diametrically opposite port 118. This second port opens upwardly to a radial recess 122 in the lower face of the valve wafer 80, which recess opens radially inward to a central valve cavity 124 in the latter wafer. Valve cavity 124 opens upwardly to the upper valve wafer recess 114 through a valve passage 126 which is reduced to form a flange-like valve seat 128 between the recess 114 and cavity 124.

Pump wafer 84 has a coaxial recess 130 in its lower face, the lower side of which is spanned and closed by pump diaphragm 53. Recess 130 communicates to the flapper valve port 118 through a flapper valve port 132 and to the flapper valve port 120 through a flapper valve port 134. Formed in the upper face of the pump wafer 84 is a recess 136 to which the valve ports 118, 132 open. Formed in the lower face of the flapper wafer 82 is a recess 138 to which the valve ports 120, 134 open.

As noted earlier, during operation of the pump 10, fuel flows from the pump inlet 44 to the pump outlet 48 through the fuel passage 54. This fuel passage comprises, in succession from the inlet to the outlet, the top wafer bore 100 and recess 104, the transfer and valve wafer bores 108 and recess 112, the flapper valve ports 118, 132, the chamber formed by the pump wafer recess 130 and pump diaphragm 53, the flapper valve ports 134, 120, the valve wafer recess 122 and cavity 124, valve port 126, the chamber formed by the valve wafer recess 114 and regulator diaphragm 92, the transfer and valve wafer bores 110, and the top wafer recess 106 and bore 102. In the ensuing description, the chamber formed by the pump diaphragm 53 and pump wafer recess 130 is referred to as a pump chamber 130. The chamber formed by the regulator diaphragm 92 and valve wafer recess 114 is referred to as a regulator chamber 114. Flapper valve ports 118, 132 are referred to in places are entrance and exit suction ports, respectively, and the flapper valve ports 134, 120 as entrance and exit discharge ports, respectively.

As mentioned earlier and explained in more detail presently, the pumping pulsator or diaphragm 53 is driven in a pulsating pumping motion by the pressure fluctuations or pulses in the engine crankcase chamber 36. The flapper valve disc 94 has flapper valve means 140 which operate in conjunction with this pulsating pumping motion of the diaphragm 53 to control fuel flow through the flapper valve ports 118, 132, 134, 120 in such a way as to effect pumping of fuel from the pump inlet 44, through the pump chamber 130 and regulator chamber 114 to the pump outlet 48.

To this end, the flapper valve means 140 comprise a pair of hinged flapper valves 142, 144 on the valve disc 94. In the particular pump illustrated, the valve disc comprises a thin disc of flexible material, such as plastic which is slotted in the manner shown in FIG. 5 to form the flapper valves 142, 144 and these valves are rectangular blade-like elements which are integrally joined at one end to the disc in such a way that the valves are flexible or deflectible from and into the plane of the disc. The elasticity of the valve disc material yieldably retains the valves in normal positions (shown in FIG. 6) wherein they are located in the plane of the disc. In the ensuing description, the flapper valves 142, 144 are referred to as suction and discharge valves, respectively.

Figure 7:
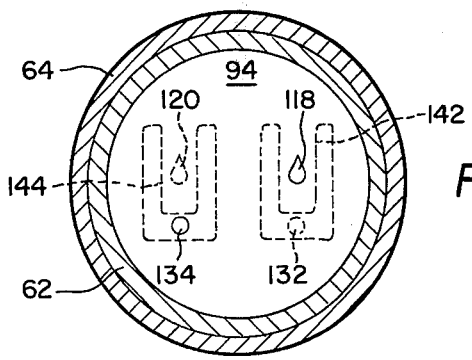
FIG. 7 is a section taken on line 7—7 of FIG. 6.

As already noted, and shown in FIG. 6, the flapper valve disc 94 is interposed between the flapper wafer 82 and pump wafer 84. The suction flapper valve 142 is located in the pump wafer recess 136 and in its normal position seats flat against the adjacent face of the flapper wafer 82 with its outer movable end overlying and closing the entrance suction port 118. The discharge flapper valve 144 is located in the flapper wafer recess 138 and in its normal position seats flat against the adjacent face of the pump wafer 84 with its outer movable end overlying and closing the entrance discharge port 134. These wafer faces against which the flapper valves seat in their normal or closed positions are referred to as the flapper valve seats. The wafer recesses 136, 138 constitute flapper valve clearance recesses which are rectangular in shape like the flapper valves and are sized to permit deflection of the flapper valves away from their valve seats and out of the plane of the flapper valve disc 94 to open positions. Referring to FIG. 7, it will be seen that the exit suction and discharge flapper valve ports 132, 120 are located beyond the outer movable ends of their respective flapper valves 142, 144, so that the latter ports uncovered by the valves and communicate with the entrance suction ports 118, 134 when the valves are in open position.

Consider now the operation of the pump 12 to this point, assuming that the pump diaphragm 53 is moving with a pulsating motion toward and away from the pump chamber 130 and that the pump inlet 44 is connected to a fuel supply. During each stroke of the diaphragm 53 away from the pump chamber (suction stroke), a partial vacuum is created in the chamber which unseats or opens the suction valve 142, seats or closes the discharge valve 144, and draws fuel into the chamber through the suction ports 118, 132 from the pump inlet 44. The following stroke of the diaphragm 53 toward the pump chamber 130 (discharge stroke) creates a positive pressure in the chamber which seats or closes the suction valve 142, unseats or opens the discharge valve 144, and displaces fuel from the chamber through the discharge ports 134, 120 and the regulator chamber 114 to the pump outlet 48. Thus, pulsating motion of the diaphragm 53 is operative to pump fuel from the pump inlet to the pump outlet.

While the above pumping action is operative to deliver fuel from a fuel tank to the engine 10, such pumping action alone is not sufficient in itself to accomplish satisfactory engine operation, which requires in addition fuel delivery to the engine at substantially constant pressure. Moreover, it is desirable to prevent fuel leakage through the pump when the engine ceases operation to avoid flooding of the engine and contamination of the airplane or its support by fuel. These functions of fuel leakage prevention and fuel pressure regulation are accomplished b the fuel cut-off valve 56 and fuel pressure regulating valve 58, respectively.

Valves 56 and 58 have a common element in the form of a valve stem 146 which extends between the regulator cavity 124 and the regulator diaphragm 92 and through the valve port 126 and regulator chamber 114, coaxially therewith. On the upper end of the valve stem in FIG. 6 is a flange 148 which seats against the adjacent side of the regulator diaphragm and a coaxial post 150 which extends through a central hole in the diaphragm. Press fitted on the upper end of the post is a collar 152 which seats against the regulator diaphragm in such a way that the latter is firmly clamped between the collar and the stem flange 148 to both secure and seal the valve stem 146 to the diaphragm.

Fitted over the the valve stem post 150 is a compression spring 154 which extends upwardly through aligned bores 156, 158 in the top and transfer wafers 76, 78 and seats at the ends against the valve stem collar 152 and a set screw 160 threaded in the top wafer. Spring 154 urges the regulator diaphragm 92 toward the regulator chamber 114 and the valve stem 146 toward the valve seat 128. The space above the diaphragm is vented to atmosphere through a vent port 161.

Fixed on the valve stem 146 within the regulator cavity 124 is a regulator valve head 162 with a spherically curved seating surface facing the valve seat 128. Loosely mounted on the stem within the regulator chamber 114 is a shut-off valve head 164 having a spherically curved seating surface facing the valve seat 128 and a relatively sharp annular edge facing the valve stem flange. As shown in FIG. 6, there is substantial clearance between the valve stem 146 and the valve head 164, such that the head may undergo relative movement with respect to the stem.

From the foregoing description of the fuel cut-off and pressure regulating valves 56, 58, it will be understood that the pressure regulating diaphragm 92, and hence the valve stem 146, are positioned by two opposinb forces, to wit, the force exerted by the fuel pressure in the pressure regulating chamber 114 and the opposing force exerted by the spring 154. It is evident that if the fuel within the regulating chamber is at atmospheric pressure or less, the combined force of the spring 154 and atmospheric pressure on the diaphragm will deflect the latter downwardly in FIG. 6 until the fuel cut-off valve head 164 engages the upper side of the valve seat 128, thereby closing the valve port 126. This is the closed position of the fuel cut-off valve 56 wherein the latter blocks fuel leakage through the pump. It is significant to note here that because of the loose fit of the valve head 164 on the valve stem 146 and the spherical seating face of the head, the latter will seat squarely against the valve seat 128 to seal the valve port 126 even though the valve stem and/or regulating diaphragm are cocked from their aligned positions of FIG. 6. That is to say, the valve head 164 may shift laterally, if necessary, to engage the valve seat because of the head-stem clearance, and the head will seat squarely on the valve seat through a range of angular positions of the head relative to the seat because of the curved seating face of the head. It will be understood, of course, that engagement of the sharp annular edge of the valve head 164 with the valve stem flange 148 seals the head to the flange.

Assume now that the fuel pressure in the regulating cavity 124 gradually increases. At some minimum pressure level, determined by the force of the spring 154 on the diaphragm 92, the opposing fuel pressure and spring forces on the valve head 164 will be balanced. Continued increasing fuel pressure in the cavity will then displace the valve head and diaphragm upwardly in FIG. 6, thereby releasing the fuel cut-off valve head 164 for upward movement from the valve seat 128 to open the valve port 126 and admit fuel to the regulator chamber. The increasing fuel pressure in the chamber then acts directly on the regulator diaphragm to displace the latter further. This upward displacement of the diaphragm draws the pressure regulating valve head 162 upwardly toward the underside of the valve seat 128, thereby gradually restricting the annular flow space between the seat and the latter head and hence the fuel flow to the regulator chamber. The fuel pressure in the chamber then starts to decrease with resultant downward displacement of the diaphragm and the regulator valve head 162 by the spring 154. This again increases the fuel flow to and fuel pressure in the regulator chamber.

Consider now the operation of the fuel pump 12 in the light of the above description of the valves 56, 58, assuming the pump inlet 44 is connected to a fuel supply and the pump diaphragm 53 is initially stationary. Under these conditions, the valve spring 154 retains the fuel shut-off valve 56 closed with its valve head 164 in seating contact with the valve seat 128 to prevent fuel leakage through the pump under the force of the fuel head pressure and/or other forces active on the fuel. The fuel pump is thus totally inactive and fuel leakage through the pump is blocked.

Assume now that the pump diaphragm 53 is driven in its pulsating pumping motion. This pumping motion of the diaphragm pumps fuel from the fuel supply, through the pump chamber 130 into the pressure regulator cavity 124, thereby exerting an upward opening force on the currently closed fuel cut-off valve head 164. Almost immediately, this opening force becomes sufficient to displace the valve head, and hence the regulator diaphragm 92, upwardly against the opposing force of the valve spring 154, thereby permitting fuel flow from the cavity 124 into the regulator chamber 114 below the regulator diaphragm and from the chamber to the pump outlet 48. Assuming some restriction to fuel flow from the pump through the pump outlet, the regulator chamber will rapidly fill with fuel, whereupon the fuel in the chamber will exert an upward force in the regulator diaphragm 92 and displace the latter upwardly against the opposing regulator spring force.

This upward displacement of the regulator diaphragm 92 by the fuel pressure in the regulator chamber 114 gradually pulls the regulator valve head 162 toward the valve seat 128, thereby gradually restricting the fuel flow into the regulator chamber 114. Assuming that the restriction to fuel flow from the pump remains constant, upward displacement of the regulator diaphragm 92 and resultant closing of the regulator valve 58 by the fuel pressure in the regulator chamber 114 will continue until the closing regulator valve restricts fuel flow into the chamber sufficiently to cause the chamber pressure to decrease slightly. The valve spring 154 then commences to open the regulator valve 58 more and admit more fuel into the regulator chamber to increase the chamber pressure. Thus, the regulator valve 58 acts to maintain in the regulator chamber 114, and hence at the pump outlet 48, a relatively constant fuel pressure determined by the force exerted on the regulator diaphragm 92 by the valve spring 154. If the resistance to fuel flow from the pump changes, the regulator valve 58 will automatically adjust to maintain the constant fuel pressure at a new fuel flow rate determined by the new restriction to fuel flow. Thus, if the restriction to fuel flow from the pump decreases, the fuel pressure regulating valve will open more to maintain the constant fuel pressure at an increased flow rate determined by the decreased restriction to fuel flow. An increase in the restriction to fuel flow will produce the opposite effect. The constant fuel delivery pressure of the pump is obviously adjustable by adjusting the valve spring set screw 160 which is readily accessible for this purpose.

Returning now to FIG. 1, the fuel pump 12 is mounted at the rear end of the crankcase 18 of the engine 10 in place of the rear crankcase closure plate of the conventional engine. To this end, the outer sleeve 64 of the fuel pump body 50 is sized to fit slidably within the rear open end of the crankcase to a position wherein the pump housing flange 72 seats against the rear crankcase face. The flange is bolted to the crankcase in the same manner as the closure plate of the conventional engine.

When thus mounted on the engine 10, the inner end of the pump housing 50 is directly exposed to the crankcase chamber 36. This inner housing end is the near end of the housing in FIG. 3 and the lower end of the housing in FIG. 6. As already described and shown in the drawings, the restrictor wafer 86 spans and is exposed at the inner housing end. This restrictor wafer has a flange 166 which fits about the pump wafer 84 and a flange 168 which projects through the end opening in the pump housing sleeve **6*e* to center the restrictor wafer. Extending through the restrictor wafer are a number of relatively large openings or ports 170 through which the pump diaphragm 53 is directly exposed to the engine crankcase chamber 36. The outwardly presented face 172 of the restrictor wafer 86 is recessed, as shown in FIG. 6, to provide between the wafer and the pump diaphragm a clearance space which accommodates pulsating pumping motion of the diaphragm. The restrictor wafer, however, restricts each inward pumping stroke of the diaphragm toward the engine crankcase chamber 36. As mentioned earlier, and shown in FIG. 1, the fuel pump inlet 44 and outlet 48 are connected to a fuel tank and the engine carburetor 28 through fuel lines or tubes 42, 46.**

The operation of the pump 12 with the engine 10 is obvious from the preceding description. Thus, as noted earlier, the reciprocating motion of the engine piston 30 in its cylinder 16 produces pressure fluctuations or pulses in the engine crankcase chamber 36. These pressure fluctuations act directly on the pump diaphragm 53 to drive the latter in its pulsating pumping motion and thereby pump fuel from the engine fuel tank to the engine carburetor under a relatively constant delivery pressure determined by the setting of the pump valve spring adjustment screw 154 and at a delivery rate determined by the setting of the carburetor throttle valve. In this regard, it will be understood that opening the throttle valve to increase engine speed reduces the restriction to fuel flow from the pump, thereby resulting in increased fuel flow at the constant fuel delivery pressure. Closing the throttle valve has the opposite effect. The adjustment screw is readily accessible at the outer end of the pump for adjustment to regulate the fuel delivery pressure.

The fuel pump of the invention has several advantages which are obvious from the foregoing description and hence need not be explained in great detail. One advantage, for example, resides in the fact that fuel is delivered to the engine carburetor at constant pressure determined by the setting of the regulator adjustment screw 154, regardless of the fuel pressure head, forces of flight active on the fuel, and other forces which would tend to vary the fuel pressure and thereby engine operation. Adjustment screw 154 is readily accessible at the outer end of the pump for adjustment to obtain a desired fuel delivery pressure. Mounting of the pump directly on the engine with the pump diaphragm 53 directly exposed to the pressure fluctuations in the engine crankcase chamber 36 permits an efficient fuel pumping action. These advantages eliminate the necessity of utilizing carburetor venturi vacuum to draw fuel to the engine thereby permitting the utilization of a larger carburetor bore with resultant increased intake air flow and engine power. The wafer construction of the pump simplifies its construction and assembly, thereby reducing the cost and simplifying servicing and repair of the pump, if necessary. In this regard, it will be seen in FIG. 5 that the wafers of the pump are aligned by mating pins 174 and holes 176 on the wafers whereby to facilitate proper assembly of the pump. Another unique feature of the pump resides in its pressure regulating and full cut-off valves 56, 58. As already noted, for example, the cut-off valve head 164 is loosely mounted on the valve stem 146 and has a spherical seating face, such that it may properly seat on its valve seat 128 to block fuel flow even though the valve stem is not precisely aligned with the valve seat axis. In contrast to conventional pressure regulating valves, the regulating valve head 164 is pulled toward its valve seat 128 to restrict fuel flow, thereby simplifying the valve construction and eliminating the need for the additional elements which are necessary in conventional regulating valves.

As noted earlier, while the fuel pump has been described in connection with its use on a model airplane, the pump may obviously be adapted for use on other engines of the character discussed at the outset of the description.

What is claimed as new in support of Letters Patent is:

1. In combination:

an internal combustion engine including a body having a cylinder opening at one end to a crankcase chamber in said body, a piston movable in said cylinder with a reciprocating motion which produces cyclic pressure fluctuations within said chamber, and a crankshaft in said chamber connected to said piston for rotation by reciprocation of the piston and having an output end extending externally of said body at one end of said chamber, the other chamber end opening to the exterior of said body;

a fuel pump including a housing removably positioned on said engine body with one end of said housing exposed to said chamber through said open chamber end, a fuel inlet and a fuel outlet adjacent the other end of said housing, and fuel pumping means in said housing including a pumping pulsator at said one housing end exposed directly to said chamber through port means in the latter housing end having a relatively large cross-sectional dimension compared to the axial dimension of said port means and movable endwise of the housing in a pulsating pumping motion by said chamber pressure fluctuations for pumping fuel from said inlet to said outlet; and means removably securing said pump housing to said engine body.

2. The combination according to claim 1 wherein:

said one end of said pump housing fits removably within said open chamber end and said pump housing has a flange seating against said engine body about said open chamber end;

said securing means comprise bolts extending through said flange into said engine body; and said fuel pump comprises a diaphragm pump and said pumping pulsator comprises a pump diaphragm extending across said one end of said housing directly behind said port means.

3. In combination:

an internal combustion engine having a cylinder opening at one end to a crankcase chamber and a piston movable in said cylinder with a reciprocating motion which produces cyclic pressure fluctuations within said chamber;

a fuel pump including a housing mounted directly on said engine, a fuel inlet and fuel outlet on said housing, a fuel passage in said housing communicating said fuel inlet and outlet, pumping means in said housing including a pumping pulsator in said passage exposed directly to said crankcase chamber and movable in a pulsating pumping motion by said chamber pressure fluctuations for pumping fuel through said passage from said inlet to said outlet; and a fuel cut-off valve means within said housing and in said passage for closing said passage to totally block fuel leakage through said passage when operation of said pumping means ceases due to cessation of engine operation.

4. In combination:

an internal combustion engine having a cylinder opening at one end to a crankcase chamber and a piston movable in said cylinder with a reciprocating motion which produces cyclic pressure fluctuations within said chamber;

a fuel pump including a housing mounted directly on said engine, a fuel inlet and fuel outlet on said housing, a fuel passage in said housing communicating said fuel inlet and outlet, pumping means in said housing including a pumping pulsator in said passage exposed directly to said crankcase chamber and movable in a pulsating pumping motion by said chamber pressure fluctuations for pumping fuel through said passage from said inlet to said outlet; and a fuel pressure regulating valve means within said housing and in said passage for maintaining a relatively constant fuel pressure at said pump outlet.

5. The combination according to claim 4 wherein:

said fuel pump includes a fuel cut-off valve within said housing and in said passage for closing said passage to totally block fuel leakage through said passage when operation of said engine ceases due to cessation of engine operation; and said valves include a common valve actuating diaphragm responsive to fuel pressure in said passage.

6. The combination according to claim 4 wherein:

said regulating valve comprises a fuel chamber forming a part of said fuel passage between and communicating said pumping means and pump outlet, a diaphragm bounding one side of said fuel chamber, a valve seat about said passage between said pumping means and fuel chamber, a regulator valve head in said passage between said pumping means and valve seat, means connecting said diaphragm and valve head, whereby increasing fuel pressure in said fuel chamber displaces said diaphragm in a direction to draw said valve head toward said valve seat to restrict fuel flow into said fuel chamber, and a spring for yieldably urging said diaphragm in the opposite direction.

7. The combination according to claim 6 including:

a fuel cut-off valve head within said fuel chamber and secured to said diaphragm whereby displacement of said diaphragm in said opposite direction engages said latter head with said seat to block fuel leakage through said passage.

8. The combination according to claim 3 wherein:

said cut-off valve comprises a fuel chamber forming a part of said fuel passage between and communicating with pumping means and pump outlet, a diaphragm bounding one side of said fuel chamber, a valve seat about said passage between said fuel chamber and pumping means and opposite said diaphragm, a spring for urging said diaphragm toward said valve seat, a valve head within said fuel chamber, and means connecting said valve head and diaphragm whereby displacement of said diaphragm toward said valve seat engages said valve head with said seat to block fuel leakage through said passage.

9. The combination according to claim 8 wherein:

said connecting means comprises a valve stem extending through a central opening in said valve head, and said valve head opening is enlarged relative to said valve stem to permit self-centering movement of said valve head relative to said valve stem and alve seat.

10. In combination:

an internal combustion engine having a cylinder opening at one end to a crankcase chamber and a piston movable in said cylinder with a reciprocating motion which produces cyclic pressure fluctuations within said chamber; and a fuel pump including a housing mounted directly on said engine, a fuel inlet and fuel outlet on said housing, a stack of wafers within said housing having openings defining a fuel passage through said wafers communicating said pump inlet and outlet, pumping means in said housing including a pumping pulsator in said passage exposed directly to said crankcase chamber and movable in a pulsating pumping motion by said pressure fluctuations, one of said wafers having a recess forming with said pulsator a pump chamber constituting a portion of said passage, a valve disc between adjacent wafers of said stack and flapper valves in said disc for regulating fuel flow into and from said pump chamber in response to said pulsating pumping motion of said pulsator in such a way as to cause fuel flow through said passage from said inlet to said outlet certain of said wafers forming a fuel chamber between said pump chamber and pump outlet, and constituting a part of said passage, a diaphragm bounding said fuel chamber, and valve means connected to said diaphragm for movement toward and away from a valve seat about said passage for blocking fuel leakage through said passage when engine operation ceases and maintaining a relatively constant fuel pressure at said pump outlet during engine operation.

11. A fuel pump for an internal combustion engine having a body having a cylinder opening at one end to a crank-case chamber in said body, a piston movable in said cylinder with a reciprocating motion which produces cyclic pressure fluctuations within said chamber and a crankshaft in said chamber connected to said piston for rotation by reciprocation of said piston and having an output end extending externally of said body at one end of said chamber, the other chamber end opening to the exterior of said body, comprising:

a housing having fuel inlet and a fuel outlet adjacent one end of the housing and a passage communicating with said inlet and outlet;

means for mounting said housing on said engine body with the opposite housing and exposed to said chamber through said open chamber end;

fuel pumping means within said housing including a pumping pulsator in said passage at said opposite housing end movable endwise of said housing in a pulsating pumping motion by said pressure fluctuations for pumping fuel from said inlet to said outlet; and port means at said opposite housing end having a relatively large cross-sectional dimension compared to the axial dimension of the port means for exposing said pulsator to said chamber pressure fluctuations.

12. A fuel pump according to claim 11 wherein:

said opposite housing end is sized to fit removably within said open end of the engine crankcase chamber;

said mounting means comprises a flange about said housing spaced from said opposite housing end for seating against said engine body about said open chamber end and having holes for receiving screws and securing said flange to said body; and said fuel pump comprises a diaphragm pump and said pumping pulsator comprises a pump diaphragm directly behind said port means.

13. A fuel pump for an internal combustion engine having a cylinder opening at one end to a crankcase chamber and a piston movable in said cylinder with a reciprocating motion which produces cyclic pressure fluctuations in said chamber, comprising:

a housing having a fuel inlet, a fuel outlet, and a passage communicating said inlet and outlet;

means for mounting said housing on said engine;

fuel pumping means within said housing including a pumping pulsator in said passage movable in a pulsating pumping motion by said pressure fluctuations for pumping fuel from said inlet to said outlet;

port means in said housing for exposing said pulsator to said pressure fluctuations; and a fuel cut-off valve means within said housing and in said passage for closing said passage to block fuel leakage through said fuel passage when operation of said pumping means ceases due to cessation of engine operation.

14. A fuel pump for an internal combustion engine having a cylinder opening at one end to a crankcase chamber and a piston movable in said cylinder with a reciprocating motion which produces cyclic pressure fluctuations in said chamber, comprising:

a housing having a fuel inlet, a fuel outlet, and a passage communicating said inlet and outlet;

means for mounting said housing on said engine;

fuel pumping means within said housing including a pumping pulsator in said passage movable in a pulsating pumping motion by said pressure fluctuations for pumping fuel from said inlet to said outlet;

port means in said housing for exposing said pulsator to said pressure fluctuations; and a fuel pressure regulating valve means within said housing and in said passage for maintaining a relatively constant fuel pressure at said pump outlet.

15. A fuel pump according to claim 14 wherein:

said fuel pump includes a fuel cut-off valve in said passage for closing said passage to block fuel leakage through said fuel passage when operation of said pumping means ceases due to cessation of engine operation; and said valves include a common valve actuating diaphragm responsive to fuel pressure in said passage.

16. A fuel pump according to claim 14 wherein:

said regulating valve comprises a fuel chamber forming a part of said passage between and communicating said pumping means and pump outlet, a regulator diaphragm bounding one side of said fuel chamber, a valve seat about said passage between said pumping means and fuel chamber, a regulator valve head in said passage between said pumping means and valve seat, means connecting said diaphragm and valve head, whereby increasing fuel pressure in said chamber displaces said diaphragm in a direction to draw said valve head toward said valve seat to restrict fuel flow into said chamber, and a spring for yieldably urging said diaphragm in the opposite direction.

17. A fuel pump according to claim 16 including:

a fuel cut-off valve head within said fuel chamber and secured to said diaphragm whereby displacement of said diaphragm in said opposite direction engages said latter head with said seat to block fuel leakage through said passage.

18. A fuel pump according to claim 13 wherein:

said cut-off valve comprises a fuel chamber in said passage between and communicating said pumping means and pump outlet, a diaphragm bounding one side of said fuel chamber, a valve seat about said passage between aid fuel chamber and pumping means and opposite said diaphragm, a spring for urging said diaphragm toward said valve seat, a valve head within said fuel chamber, and means connecting said valve head and diaphragm, whereby displacement of said diaphragm toward said valve seat moves said valve head toward said seat to block fluid leakage through said passage.

19. A fuel pump according to claim 18 wherein:

said connecting means comprises a valve stem extending through a central opening in said valve head, and said valve head opening is enlarged relative to said valve stem to permit self-centering movement of said valve head relative to said valve stem and valve seat.

20. A fuel pump for an internal combustion engine having a body having a cylinder opening at one end to a crankcase chamber in said body, a piston movable in said cylinder with a reciprocating motion which produces cyclic pressure fluctuations within said chamber and a crankshaft in said chamber connected to said piston for rotation by reciprocation of said piston and having an output end extending externally of said body at one end of said chamber, the other chamber end opening to the exterior of said body, comprising:

a fuel pump including a housing to be mounted directly on said engine, a fuel inlet and a fuel outlet on said housing, a stick of wafers within said housing having openings defining a fuel passage through said wafers communicating said pump inlet and outlet, pumping means in said housing including a pumping pulsator in said passage movable in a pulsating pumping motion by said pressure fluctuations, one of said wafers having a recess forming with said pulator a pump chamber constituting a portion of said passage, a valve disc between adjacent wafers of said stack and flapper valves in said disc for regulating fuel flow into and from said pump chamber in response to said pulsating pumping motion of said pulsator in such a way as to cause fuel flow through said passage from said inlet to said outlet, certain of said wafers forming a fuel chamber between said pump chamber and pump outlet, and constituting a part of said passage, a diaphragm bounding said fuel chamber, and valve means connected to said diaphragm for movement toward and away from a valve seat about said passage for blocking fuel leakage through said passage when engine operation ceases and maintaining a relatively constant fuel pressure at said pump outlet during engine operation.

* * * * *